US008094113B2

(12) United States Patent
Yokota et al.

(10) Patent No.: US 8,094,113 B2
(45) Date of Patent: Jan. 10, 2012

(54) LIQUID CRYSTAL DISPLAYING APPARATUS USING DATA LINE DRIVING CIRCUIT

(75) Inventors: Junya Yokota, Kanagawa (JP); Yoshiharu Hashimoto, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1584 days.

(21) Appl. No.: 11/449,773

(22) Filed: Jun. 9, 2006

(65) Prior Publication Data

US 2006/0279514 A1 Dec. 14, 2006

(30) Foreign Application Priority Data

Jun. 10, 2005 (JP) ..... 2005-170534

(51) Int. Cl.
*G09G 3/36* (2006.01)

(52) U.S. Cl. ..... 345/98; 345/100

(58) Field of Classification Search ..... 345/98–100, 345/87–89, 90, 92, 103, 204; 349/33, 41, 349/42

See application file for complete search history.

(56) References Cited

U.S. PATENT DOCUMENTS

| | | | | |
|---|---|---|---|---|
| 4,739,320 | A * | 4/1988 | Dolinar et al. | 345/78 |
| 5,412,397 | A * | 5/1995 | Kanatani et al. | 345/99 |
| 5,559,526 | A * | 9/1996 | Izawa | 345/96 |
| 5,748,165 | A * | 5/1998 | Kubota et al. | 345/96 |
| 6,014,122 | A * | 1/2000 | Hashimoto | 345/98 |
| 6,466,192 | B2 * | 10/2002 | Imamura | 345/98 |
| 6,661,402 | B1 * | 12/2003 | Nitta et al. | 345/99 |
| 7,292,217 | B2 * | 11/2007 | Tseng et al. | 345/100 |
| 2001/0038427 | A1 * | 11/2001 | Ueda et al. | 349/74 |
| 2002/0063674 | A1 * | 5/2002 | Chiang | 345/98 |
| 2002/0075249 | A1 * | 6/2002 | Kubota et al. | 345/204 |
| 2004/0257325 | A1 * | 12/2004 | Inoue | 345/89 |
| 2005/0052381 | A1 * | 3/2005 | Lee et al. | 345/87 |
| 2006/0232539 | A1 * | 10/2006 | Hashimoto | 345/96 |
| 2007/0146354 | A1 * | 6/2007 | Kubota et al. | 345/204 |
| 2008/0024420 | A1 * | 1/2008 | Nakai et al. | 345/98 |

FOREIGN PATENT DOCUMENTS

JP 6-149183 5/1994

* cited by examiner

*Primary Examiner* — Seokyun Moon
(74) *Attorney, Agent, or Firm* — McGinn Intellectual Property Law Group, PLLC

(57) ABSTRACT

A liquid crystal display apparatus includes a plurality of data lines; a plurality of scan lines which intersect the plurality of data lines; pixels arranged at intersections of the plurality of data lines and the plurality of scanning lines; and a data line driving circuit configured to drive the plurality of data lines, and comprising a first data line driving section and a second data line driving section. 4×n (n: an optional natural number) frames are set as one cycle, and each of the plurality of data lines is circularly driven by one of the first data line driving section and the second data line driving section during one cycle.

2 Claims, 16 Drawing Sheets

Fig. 11A

| 1ST FRAME | 2ND FRAMES | 3RD FRAME | 4TH FRAME |
|---|---|---|---|
| UP + | DOWN − | DOWN + | UP − |

Fig. 11B

| 1ST FRAME | 2ND FRAMES | 3RD FRAME | 4TH FRAME |
|---|---|---|---|
| UP + | UP − | DOWN + | DOWN − |

Fig. 13A

1ST FRAME

| | | | | |
|---|---|---|---|---|
| 1 | UP + | DOWN − | DOWN + | UP − |
| 2 | DOWN − | DOWN + | UP − | UP + |
| 3 | DOWN + | UP − | UP + | DOWN − |
| 4 | UP − | UP + | DOWN − | DOWN + |

Fig. 13B

2ND FRAME

| | | | | |
|---|---|---|---|---|
| 1 | DOWN − | DOWN + | UP − | UP + |
| 2 | DOWN + | UP − | UP + | DOWN − |
| 3 | UP − | UP + | DOWN − | DOWN + |
| 4 | UP + | DOWN − | DOWN + | UP − |

Fig. 13C

3RD FRAME

| | | | | |
|---|---|---|---|---|
| 1 | DOWN + | UP − | UP + | DOWN − |
| 2 | UP − | UP + | DOWN − | DOWN + |
| 3 | UP + | DOWN − | DOWN + | UP − |
| 4 | DOWN − | DOWN + | UP − | UP + |

Fig. 13D

4TH FRAME

| | | | | |
|---|---|---|---|---|
| 1 | UP − | UP + | DOWN − | DOWN + |
| 2 | UP + | DOWN − | DOWN + | UP − |
| 3 | DOWN − | DOWN + | UP − | UP + |
| 4 | DOWN + | UP − | UP + | DOWN − |

Fig. 14A

1ST FRAME

| | | | | |
|---|---|---|---|---|
| 1 | UP + | DOWN − | UP − | DOWN + |
| 2 | DOWN − | DOWN + | UP + | UP − |
| 3 | DOWN + | UP − | DOWN − | UP + |
| 4 | UP − | UP + | DOWN + | DOWN − |

Fig. 14B

2ND FRAME

| | | | | |
|---|---|---|---|---|
| 1 | DOWN − | DOWN + | UP + | UP − |
| 2 | DOWN + | UP − | DOWN − | UP + |
| 3 | UP − | UP + | DOWN + | DOWN − |
| 4 | UP + | DOWN − | UP − | DOWN + |

Fig. 14C

3RD FRAME

| | | | | |
|---|---|---|---|---|
| 1 | DOWN + | UP − | DOWN − | UP + |
| 2 | UP − | UP + | DOWN + | DOWN − |
| 3 | UP + | DOWN − | UP − | DOWN + |
| 4 | DOWN − | DOWN + | UP + | UP − |

Fig. 14D

4TH FRAME

| | | | | |
|---|---|---|---|---|
| 1 | UP − | UP + | DOWN + | DOWN − |
| 2 | UP + | DOWN − | UP − | DOWN + |
| 3 | DOWN − | DOWN + | UP + | UP − |
| 4 | DOWN + | UP − | DOWN − | UP + |

Fig. 15A

1ST FRAME

| | | | | |
|---|---|---|---|---|
| 1 | UP + | DOWN − | DOWN + | UP − |
| 2 | DOWN + | UP − | UP + | DOWN − |
| 3 | UP − | UP + | DOWN − | DOWN + |
| 4 | DOWN − | DOWN + | UP − | UP + |

Fig. 15B

2ND FRAMES

| | | | | |
|---|---|---|---|---|
| 1 | DOWN − | DOWN + | UP − | UP + |
| 2 | UP − | UP + | DOWN − | DOWN + |
| 3 | UP + | DOWN − | DOWN + | UP − |
| 4 | DOWN + | UP − | UP + | DOWN − |

Fig. 15C

3RD FRAME

| | | | | |
|---|---|---|---|---|
| 1 | DOWN + | UP − | UP + | DOWN − |
| 2 | UP + | DOWN − | DOWN + | UP − |
| 3 | DOWN − | DOWN + | UP − | UP + |
| 4 | UP − | UP + | DOWN − | DOWN + |

Fig. 15D

4TH FRAME

| | | | | |
|---|---|---|---|---|
| 1 | UP − | UP + | DOWN − | DOWN + |
| 2 | DOWN − | DOWN + | UP − | UP + |
| 3 | DOWN + | UP − | UP + | DOWN − |
| 4 | UP + | DOWN − | DOWN + | UP − |

Fig. 15E

5TH FRAME

| | | | | |
|---|---|---|---|---|
| 2 | UP + | DOWN − | DOWN + | UP − |
| 1 | DOWN + | UP − | UP + | DOWN − |
| 4 | UP − | UP + | DOWN − | DOWN + |
| 3 | DOWN − | DOWN + | UP − | UP + |

Fig. 15F

6TH FRAME

| | | | | |
|---|---|---|---|---|
| 2 | DOWN − | DOWN + | UP − | UP + |
| 1 | UP − | UP + | DOWN − | DOWN + |
| 4 | UP + | 下− | DOWN + | UP − |
| 3 | DOWN + | UP − | UP + | DOWN − |

Fig. 15G

7TH FRAME

| | | | | |
|---|---|---|---|---|
| 2 | DOWN + | UP − | UP + | DOWN − |
| 1 | UP + | DOWN − | DOWN + | UP − |
| 4 | DOWN − | DOWN + | UP − | UP + |
| 3 | UP − | UP + | DOWN − | DOWN + |

Fig. 15H

8TH FRAME

| | | | | |
|---|---|---|---|---|
| 2 | UP − | UP + | DOWN − | DOWN + |
| 1 | DOWN − | DOWN + | UP − | UP + |
| 4 | DOWN + | UP − | UP + | DOWN − |
| 3 | UP + | DOWN − | DOWN + | UP − |

Fig. 16A

1ST FRAME

| | | | | |
|---|---|---|---|---|
| 1 | UP + | DOWN − | UP − | DOWN + |
| 2 | DOWN + | UP − | DOWN − | UP + |
| 3 | UP − | UP + | DOWN + | DOWN − |
| 4 | DOWN − | DOWN + | UP + | UP − |

Fig. 16B

2ND FRAMES

| | | | | |
|---|---|---|---|---|
| 1 | DOWN − | DOWN + | UP + | UP − |
| 2 | UP − | UP + | DOWN + | DOWN − |
| 3 | UP + | DOWN − | UP − | DOWN + |
| 4 | DOWN + | UP − | DOWN − | UP + |

Fig. 16C

3RD FRAME

| | | | | |
|---|---|---|---|---|
| 1 | DOWN + | UP − | DOWN − | UP + |
| 2 | UP + | DOWN − | UP − | DOWN + |
| 3 | DOWN − | DOWN + | UP + | UP − |
| 4 | UP − | UP + | DOWN + | DOWN − |

Fig. 16D

4TH FRAME

| | | | | |
|---|---|---|---|---|
| 1 | UP − | UP + | DOWN + | DOWN − |
| 2 | DOWN − | DOWN + | UP + | UP − |
| 3 | DOWN + | UP − | DOWN − | UP + |
| 4 | UP + | DOWN − | UP − | DOWN + |

Fig. 16E

5TH FRAME

| | | | | |
|---|---|---|---|---|
| 2 | UP + | DOWN − | UP − | DOWN + |
| 1 | DOWN + | UP − | DOWN − | UP + |
| 4 | UP − | UP + | DOWN + | DOWN − |
| 3 | DOWN − | DOWN + | UP + | UP − |

Fig. 16F

6TH FRAME

| | | | | |
|---|---|---|---|---|
| 2 | DOWN − | DOWN + | UP + | UP − |
| 1 | UP − | UP + | DOWN + | DOWN − |
| 4 | UP + | DOWN − | UP − | DOWN + |
| 3 | DOWN + | UP − | DOWN − | UP + |

Fig. 16G

7TH FRAME

| | | | | |
|---|---|---|---|---|
| 2 | DOWN + | UP − | DOWN − | UP + |
| 1 | UP + | DOWN − | UP − | DOWN + |
| 4 | DOWN − | DOWN + | UP + | UP − |
| 3 | UP − | UP + | DOWN + | DOWN − |

Fig. 16H

8TH FRAME

| | | | | |
|---|---|---|---|---|
| 2 | UP − | UP + | DOWN + | DOWN − |
| 1 | DOWN − | DOWN + | UP + | UP − |
| 4 | DOWN + | UP − | DOWN − | UP + |
| 3 | UP + | DOWN − | UP − | DOWN + |

LIQUID CRYSTAL DISPLAYING APPARATUS USING DATA LINE DRIVING CIRCUIT

BACKGROUND OF THE INVENTION

1. Field of the Invention

The present invention relates to a driving circuit for driving data lines of a liquid crystal display panel and a liquid crystal display apparatus using the same.

2. Description of the Related Art

As a man-machine interface, a flat panel display apparatus has been widely spread. Especially, a liquid crystal display apparatus is superior in manufacturing technique, yield and cost to other flat panel displays such as a plasma display apparatus. Thus, the liquid crystal display apparatus is applicable to various fields.

The liquid crystal display apparatus includes a display panel with a plurality of pixels arranged in a matrix. The display panel has two glass plates and liquid crystal material sealed in a gap between the glass plates. The liquid crystal material has the characteristic that the orientation of molecules is changed in accordance with an application voltage. The liquid crystal display apparatus uses its characteristic to display an image on the display panel. In short, the liquid crystal display apparatus controls the application voltage to each pixel and consequently changes a quantity of light transmitted through the two glass plates to display the image on the display panel.

As a driving method of displaying an image on a display panel, there are a simple matrix driving method and an active matrix driving method. At present, the liquid crystal display apparatus employing the active matrix driving method is generally used. An active element such as TFT (Thin Film Transistor) is provided for each pixel of the display panel in the active matrix liquid crystal display apparatus. Also, the display panel includes a plurality of scan lines and a plurality of data lines (signal lines) orthogonal to the plurality of scan lines. Also, each active element includes a gate electrode, a drain electrode and a source electrode. The gate electrode of each active element is connected to a corresponding one of the scan lines extending in a row direction. Similarly, the drain electrode of each active element is connected to a corresponding one of the data lines extending in a column direction. The active matrix liquid crystal display apparatus displays an image by using a displaying method typically called a sequential driving method. In the sequential driving method, the scan lines are sequentially scanned from an upper portion to a low portion or from the low portion to the upper portion on the display panel, and consequently displays an image on the display panel. This image is referred to as a frame (or a field).

When the display panel is driven, the continuous application of a DC voltage to the pixel cause deterioration of the liquid crystal material. The liquid crystal display apparatus typically employs a driving method called an inversion driving method, in order to prevent the deterioration of the liquid crystal material. In that method, the pixels in the liquid crystal display panel are driven in an AC manner while using the active matrix driving method. In the inversion driving method, the polarity of the pixel voltage to be applied is defined as a positive or negative voltage with respect to a voltage of a common electrode (a common voltage), and the polarity is inverted for every predetermined period. In short, in the inversion driving method, the voltage higher or lower than the common voltage is defined as a positive or negative voltage. Then, the positive voltage and the negative voltage are alternately applied to a pixel from the data line through the TFT for every predetermined period. Thus, the voltage to drive the data line is also inverted for every predetermined period.

As the inversion driving method used in the liquid crystal display apparatus, there are known the [Line Inversion Driving] method in which the polarity of the pixel voltage is changed for every data line in a row direction, and a [Dot Inversion Driving] method in which the polarity of the pixel voltage is changed for every pixel. The [Dot Inversion Driving] method is employed in the recent liquid crystal display apparatus of large scale and high definition. As the dot inversion drive method, there are known a 1-line dot inversion driving method in which the polarity of the pixel voltage is inverted each time one scan lines is scanned, and a 2-line dot inversion driving method in which the polarity of the pixel voltage is inverted each time two scan lines are scanned. With the 1-line dot inversion driving method and the 2-line dot inversion driving method, flicker and the like are reduced to improve the image quality.

With the larger scale and higher definition of the liquid crystal display apparatus, there is a case that a parasitic capacitance and parasitic resistance of the data line and the scan line are increased. The increase in the parasitic capacitance and parasitic resistance of the data line causes a waveform dullness of a driving voltage signal applied to the data line from a data line driving circuit. Thus, brightnesses are sometimes different between a pixel near to the data line driving circuit and a pixel distant from it. In order to solve such a problem, a technique is proposed in Japanese Laid Open Patent Publication (JP-A-Heisei 6-149183). In this conventional technique, data line driving circuits are provided on upper and lower sides of a panel, and are switched by setting two frames as one cycle. Thus, signal voltages are averaged, thereby reducing the deviation in the brightness.

In the dot inversion driving method, the display panel is driven in the positive and negative voltages with respect to the common voltage as the reference voltage. Thus, the display panel is driven by setting the two frames as one cycle.

FIG. 1 is a block diagram showing the configuration of a conventional liquid crystal display apparatus 101 employing the conventional dot inversion driving method. With reference to FIG. 1, the conventional liquid crystal display apparatus 101 is provided with a data line driving circuit (positive) 102*a* for supplying a positive signal, a data line driving circuit (negative) 102*b* for supplying a negative signal, a scan line driving circuit 103 for supplying a scan signal; a control circuit for outputting a clock signal and an image signal to be supplied to the data line driving circuit (positive) 102*a* and the data line driving circuit (negative) 102*b*; a display panel 105, a switch circuit 162 and a switch circuit 163. Also, the display panel 105 has data lines 107, scan lines 108 and a plurality of pixels 109. As mentioned above, the conventional display panel is driven by using a first frame and a second frame in one cycle.

FIG. 1 shows the liquid crystal display apparatus 101 of the first frame cycle. As shown in FIG. 1, the odd-numbered lines of the data lines in the liquid crystal display apparatus 101 are driven with the positive signal supplied from the data line driving circuit (positive) 102*a* in the first frame. The odd-numbered lines of the data lines are driven with the negative signal supplied from the data line driving circuit (negative) 102*b* in the second frame cycle. Here, it is supposed that the pixel near the data line driving circuit (positive) 102*a* is referred to as a pixel 109*a*, and the pixel distant from it is referred to as a pixel 109*b*. At this time, a difference between the common voltage and the pixel voltage applied to the pixel

109*a* is different from a difference between the common voltage and the pixel voltage applied to the pixel 109*b*.

FIGS. 2A to 2D are timing charts showing the voltages applied to the pixels 109*a* and 109*b*. With reference to FIGS. 2A to 2D, the waveform of voltage signal on the data line in the first and second frames is shown by a solid line, and the waveform of the pixel voltage is shown by a dotted line. As mentioned above, the pixels 109*a* and 109*b* are connected to the odd-numbered data line 107 in the liquid crystal display apparatus 101.

The pixels 109*a* and 109*b* are driven by the positive pixel voltage in the first frame. The data line driving circuit (positive) 102*a* drives the pixels 109*a* and 109*b* with the positive voltage in the first frame. Since the pixel 109*a* is located close the data line driving circuit 102*a*, the voltage waveform of the pixel 109*a* on the data line 107 reaches a target voltage without any dullness. The voltage supplied from the data line 107 is applied to the liquid crystal through the TFT of the pixel. Since the ON resistance of the TFT is as high as several MΩ, the waveform of the pixel voltage is made dull, and the pixel voltage has the value of a positive voltage Va with respect to the common voltage. After that, the drive of a scan line associated with the pixel 109*a* is ended, and the pixel 109*a* holds the voltage Va. As shown in the timing charts of FIGS. 2A and 2B, the data line driving circuit 102*b* drives the pixel 109*a* with the negative voltage in the second frame. The pixel 109*a* is located distant from the data line driving circuit 102*b*. Thus, the voltage waveform of the data line 107 becomes dull. The drive of the scan line 108 associated with the pixel 109*a* is ended before reaching the target voltage. In response to the end of the scan line drive, the TFT is turned off. At this time, the pixel voltage has the value of a negative voltage Vb with respect to the common voltage, and the pixel holds the voltage Vb.

On the other hand, the data line driving circuit 102*b* drives the pixels 109*b* with the negative voltage in the second frame. The pixel 109*b* is located close the data line driving circuit 102*b*. Thus, the voltage waveform of the data line 107 reaches the targeted voltage without any dullness. For this reason, the pixel voltage has the value of a negative voltage Vc with respect to the common voltage. At this time, the waveform of the pixel voltage applied to the liquid crystal through the TFT of the pixel becomes dull due to of the ON resistance of the TFT. After that, the scan line drive is ended, and the pixel 109*b* holds the voltage Vc.

In the third frame, the pixel 109*b* is driven with the positive voltage. As shown in the timing charts of FIGS. 2A to 2D, the data line driving circuit 102*a* drives the pixel 109*b* with the positive voltage in the third frame. The pixel 109*b* is located distant from the data line driving circuit 102*a*. Thus, the voltage waveform of the data line 107 becomes dull, and the scan line drive is ended before reaching the targeted voltage. In response to the end of the scan line drive, the TFT of the pixel 109*b* is turned off. The pixel 109*b* holds a positive voltage Vd with respect to the common voltage.

Here, although the following voltage relation $$Va+Vb \approx Vc+Vd$$

is met, the brightnesses resulting from the positive voltage Va, the negative voltage Vb, the positive voltage Vd and the negative voltage Vc are slightly different from each other. This is because a positive gamma property and a negative gamma property are slightly different from each other.

SUMMARY OF THE INVENTION

In an aspect of the present invention, a liquid crystal display apparatus includes a plurality of data lines; a plurality of scan lines which intersect the plurality of data lines; pixels arranged at intersections of the plurality of data lines and the plurality of scanning lines; and a data line driving circuit configured to drive the plurality of data lines, and comprising a first data line driving section and a second data line driving section. 4×n (n: an optional natural number) frames are set as one cycle, and each of the plurality of data lines is circularly driven by one of the first data line driving section and the second data line driving section during one cycle.

Here, the first data line driving section generates a first positive voltage signal which is positive with respect to a common voltage and a first negative voltage signal which is negative with respect to the common voltage, and the second data line driving section generates a second positive voltage signal which is positive voltage with respect to the common voltage and a second negative voltage signal which is negative with respect to the common voltage. In such a case, a summation of voltages of the voltage signals applied to each pixel during the one cycle is almost equal to each other over the pixels.

Also, the first data line driving section generates a first positive voltage signal which is positive with respect to a common voltage and a first negative voltage signal which is negative with respect to the common voltage, and the second data line driving section generates a second positive voltage signal which is positive voltage with respect to the common voltage and a second negative voltage signal which is negative with respect to the common voltage. The first data line driving section drives one of the plurality of data lines in the first positive voltage signal in a first frame of the one cycle, and the second data line driving section drives the data line in the second negative voltage signal in a second frame next to the first frame in the one cycle. In addition, the second data line driving section drives the data line in the second positive voltage signal in a third frame next to the second frame in the one cycle, and the first data line driving section drives the data line in the first negative voltage signal in a fourth frame next to the third frame in the one cycle.

Also, the first data line driving section generates a first positive voltage signal which is positive with respect to a common voltage and a first negative voltage signal which is negative with respect to the common voltage, and the second data line driving section generates a second positive voltage signal which is positive voltage with respect to the common voltage and a second negative voltage signal which is negative with respect to the common voltage. The first data line driving section drives one of the plurality of data lines in the first positive voltage signal in a first frame of the one cycle, and the first data line driving section drives the data line in the first negative voltage signal in a second frame next to the first frame in the one cycle. In addition, the second data line driving section drives the data line in the second positive voltage signal in a third frame subsequent to the second frame in the one cycle, and the second data line driving section drives the data line in the second negative voltage signal in a fourth frame next to the third frame in the one cycle.

Also, the liquid crystal display apparatus may further include a common line. The data line driving circuit includes a plurality of switches configured to control connection between the plurality of data lines and the common line, and the plurality of switches connect the plurality of data lines and the common line before a polarity of said voltage signal supplied to said data line is changed.

Also, the plurality of switches includes a first switch group provided for the first data line driving section and a second switch group provided for the second data line driving section. The common line includes a first common line connected with the plurality of data lines by the first switch group; and a second common line connected with the plurality of data lines by the second switch group. The first and second switch groups connect the plurality of data lines and the first and second common before the polarity of said voltage signal supplied to the data line is changed.

Also, a voltage applied to the common line may be a liquid crystal common voltage.

Also, the first data line driving section may be formed on a first substrate which is different from a panel substrate on which a display panel having the plurality of pixels is formed. The second data line driving section may be formed on a second substrate which is different from the panel substrate and the first substrate. The display panel may have a first side orthogonal to the plurality of data lines and a second side opposing to the first side. The first data line driving section may be provided for the first side, and the second data line driving section may be provided for the second side.

Also, each of the first and second substrates may be a semiconductor substrate.

In another aspect of the present invention, a data line driving circuit which supplies an analog image signal to 4×M (M is an optional natural number) data lines, includes M positive driving circuits configured to output a positive analog image signal which is positive with respect to a reference voltage; M negative driving circuits configured to output a negative analog image signal which is negative with respect to the reference voltage; 4×M analog image signal output terminals; and a switching circuit connected with the 4×M data lines through the 4×M analog image signal output terminals. The switching circuit switches between a first state in which the positive analog image signal is supplied to the data lines, a second state in which the negative analog image signal is supplied to ones of the data lines, and a third state as a high impedance state in which no signal is supplied to the data lines.

Here, the switching circuit includes a first buffer circuit connected with the positive driving circuits; a second buffer circuit connected with the negative driving circuits; a first switch group provided between the first buffer circuit and the analog image signal output terminals to control connection between the first buffer circuit and the analog image signal output terminals; and a second switch group provided between the second buffer circuit and the analog image signal output terminals to control connection between the second buffer circuit and the analog image signal output terminals. The switching circuit may supply the positive analog image signal and the negative analog image signal to the 4×M data lines by closing the first switch group and the second switch group in a predetermined order.

Also, the switching circuit may include a first buffer circuit connected with the positive driving circuits; a second buffer circuit connected with the negative driving circuits; a first switch group configured to selectively control connection between the first buffer circuit and the positive driving circuits; and a second switch group configured to selectively control connection between the first buffer circuit and the positive driving circuits. The switching circuit may supply the positive analog image signal and the negative analog image signal to the 4×M data lines by closing the first switch group and the second switch group in a predetermined order.

Also, the switching circuit may further include a third switch group configured to control connection of the analog image signal output terminals and a common line of the liquid crystal display apparatus before a polarity of said voltage signal supplied to said data line is changed.

BRIEF DESCRIPTION OF THE DRAWINGS

FIGS. 11A and 11B are diagrams showing an operation when pixels are driven in the first embodiment;

FIGS. 13A to 13D are diagrams showing a pixel driving method in each frame in the first embodiment;

FIGS. 14A to 14D are diagrams showing a pixel driving method in each frame in the first embodiment;

FIGS. 15A to 15H are diagrams showing states in which the polarity of a signal is inverted for every two scan lines, in a second embodiment of the present invention;

FIGS. 16A to 16H are diagrams showing other states in which the polarity of a signal is inverted for every two scan lines, in a second embodiment of the present invention;

DESCRIPTION OF THE PREFERRED EMBODIMENTS

Hereinafter, a liquid crystal display apparatus having a data line driving circuit of the present invention will be described in detail with reference to the attached drawings. In the following description, components will be described with the reference symbol of a or b to discriminate the two circuits having a same configuration and installed at different positions, as in "a first data line driving circuit 2*a* and a second data line driving circuit 2*b*". Thus, when it is not necessary to take the installation position into account, the symbols a and b are omitted. Also, the present invention is not limited to the following embodiments, and one skilled in the art can easily change, add and convert components in the following embodiments within the range of the present invention.

First Embodiment

Figure 1:
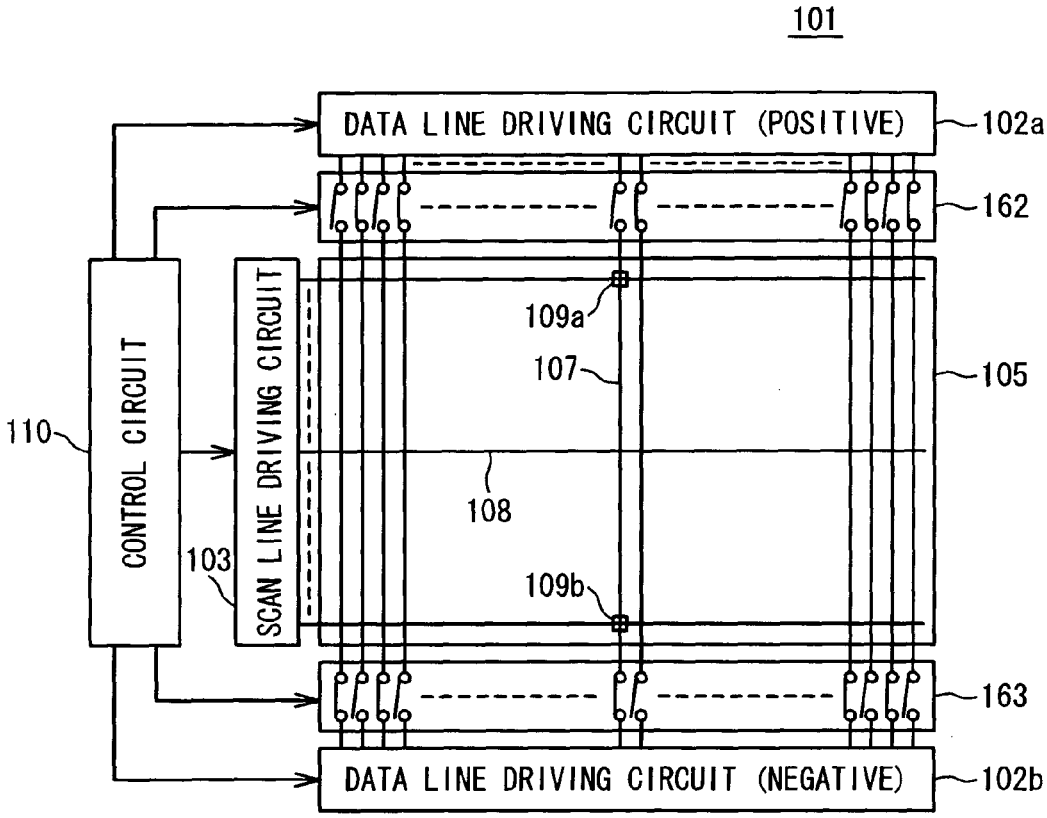
Fig. 1 PRIOR ART
FIG. 1 is a block diagram showing a configuration of a conventional liquid crystal display apparatus.
Figures 2A, 2B, 2C, 2D:
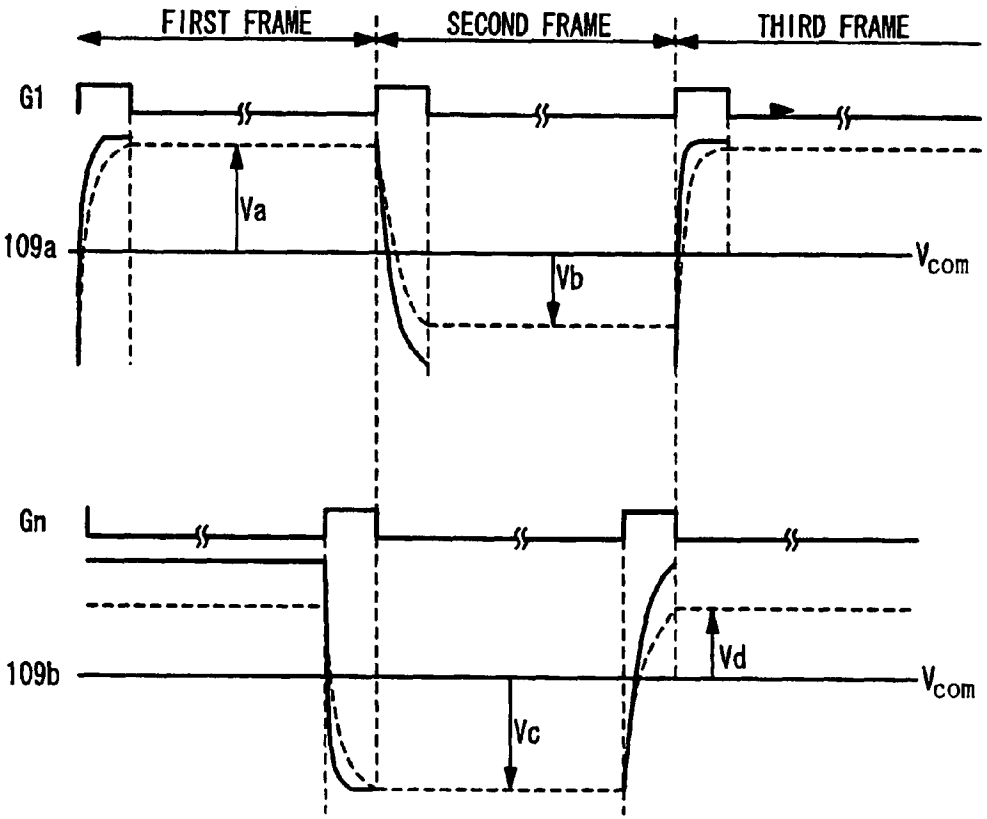
Fig. 2A (PRIOR ART)
Fig. 2B (PRIOR ART)
Fig. 2C (PRIOR ART)
Fig. 2D (PRIOR ART)
FIGS. 2A to 2D are timing charts showing voltage waveforms in the conventional liquid crystal display apparatus.
Figure 3:
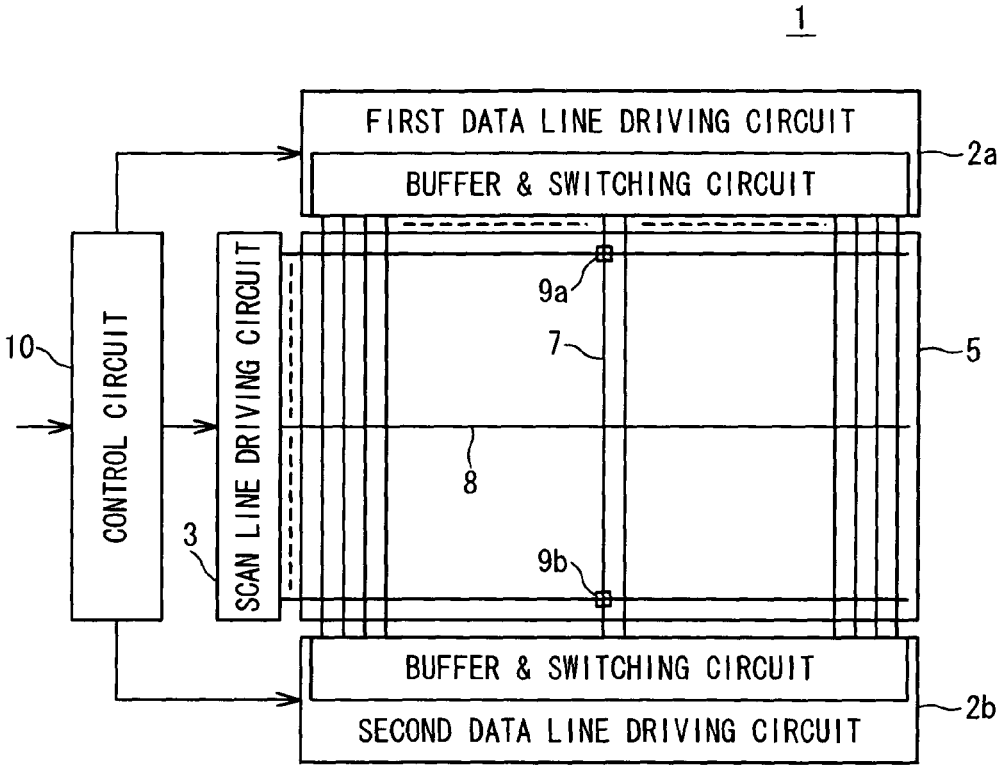
FIG. 3 is a block diagram showing a configuration of a liquid crystal display apparatus of the present invention.

FIG. 3 is a block diagram showing the configuration of a liquid crystal display apparatus 1 according to the first embodiment of the present invention. As shown in FIG. 3, the liquid crystal display apparatus 1 in this embodiment is provided with a liquid crystal display panel 5, a first data line driving circuit 2*a*, a second data line driving circuit 2*b*, a scan line driving circuit 3 and a display control circuit 10. The liquid crystal display panel 5 has a plurality of data lines 7 extending in a column direction and a plurality of scan lines 8 in a row direction orthogonal to the column direction. Also, the liquid crystal display panel 5 includes a plurality of pixels 9 arranged at the intersections of the data lines 7 and the scan lines 8. The pixels are arranged in a matrix, and an active element (not shown) such as a TFT (Thin Film Transistor) is arranged for each pixel. The active element has a gate electrode, a source electrode and a drain electrode. The gate electrode of the active element is connected to the scan line 8 extending in the row direction, and the source electrode thereof is connected to the data line 7 extending in the column direction.

The first data line driving circuit 2*a* and the second data line driving circuit 2*b* output positive signals and negative signals as analog image signals onto the plurality of data lines 7. As shown in FIG. 3, the first data line driving circuit 2*a* is provided near the upper end of the liquid crystal display panel 5, and the second data line driving circuit 2*b* is provided near the lower end of the liquid crystal display panel 5 opposing to the upper end. Each of the first data line driving circuit 2*a* and the second data line driving circuit 2*b* is connected to the plurality of data lines 7. As shown in FIG. 3, the scan line driving circuit 3 is arranged on a side between the sides on which the first data line driving circuit 2*a* and the second data line driving circuit 2*b* are provided, and is connected to the plurality of scan lines 8. The scan line driving circuit 3 outputs a scan signal. The display control circuit 10 supplies an image signal and control signals such as a clock signal to the data line driving circuits 2 and the scan line driving circuit 3. The display control circuit 10 is connected to the first data line driving circuit 2*a*, the second data line driving circuit 2*b* and the scan line driving circuit 3. The display control circuit 10 is supplied with an image signal Dx, a dot clock signal dCLK, a horizontal sync signal Hsync, a vertical sync signal Vsync and the like, and controls the image signal Dx to be supplied to which of the first data line driving circuit 2*a* and the second data line driving circuit 2*b*. The first data line driving circuit 2*a* has a first switching circuit 18*a*, and the second data line driving circuit 2*b* has a second switching circuit 18*b*. The detailed configuration of the first data line driving circuit 2*a* (or second data line driving circuit 2*b*) will be described later. As mentioned above, the liquid crystal display panel 5 includes the plurality of pixels 9. In the following description, a pixel 9*a* is assumed to be arranged on a position near the first data line driving circuit 2*a* and a pixel 9*b* is assumed to be arranged on a position near the second data line driving circuit 2*b*.

Figure 4:
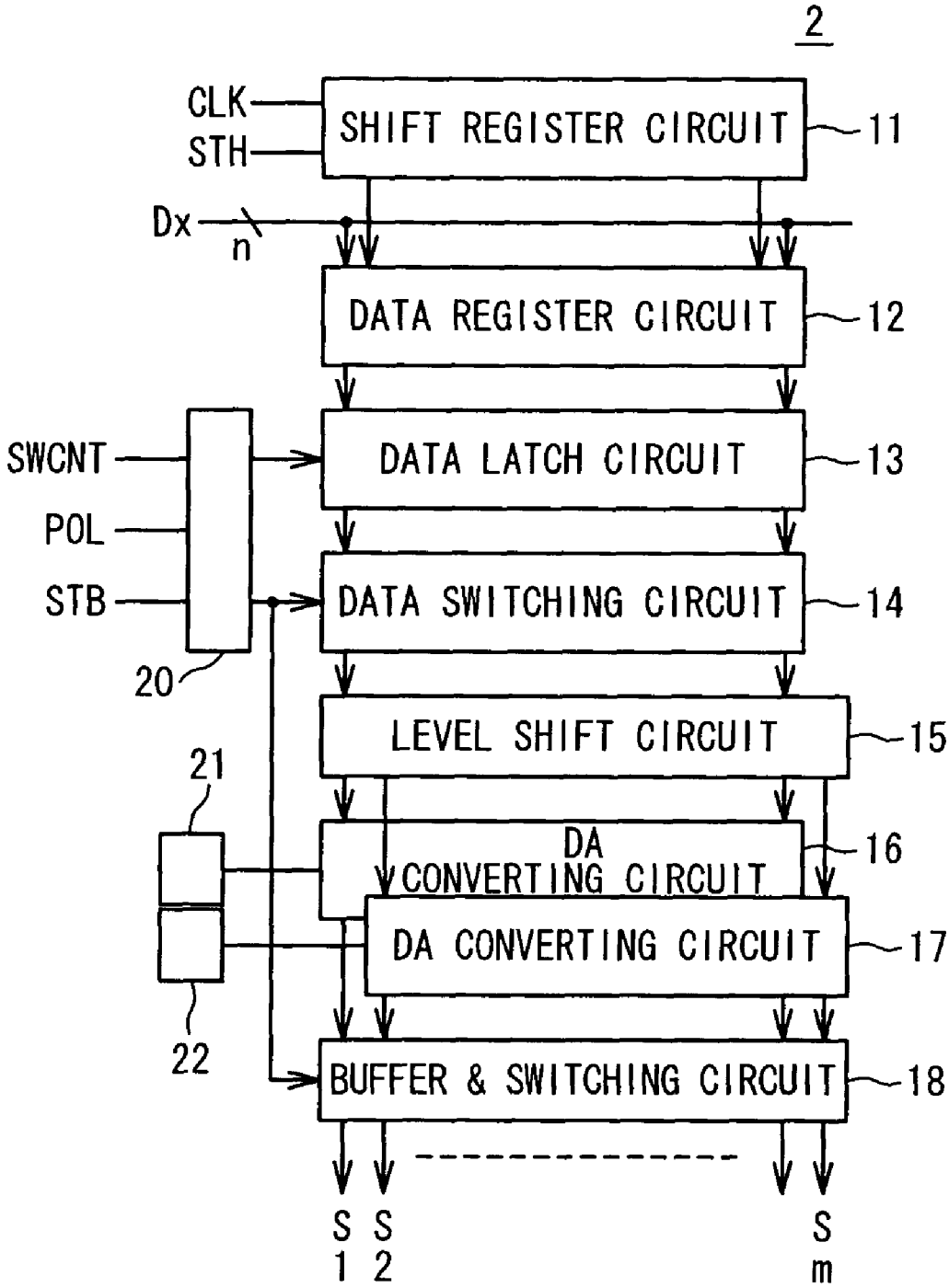
FIG. 4 is a block diagram showing a configuration of a data line driving circuit in the liquid crystal display apparatus according to the first embodiment of the present invention.

Since the first data line driving circuit 2*a* and the second data line driving circuit 2*b* have a same circuit configuration, the data line driving circuit 2 will be described. FIG. 4 is a block diagram showing the configuration of the data line driving circuit 2 in the first embodiment. As shown in FIG. 4, the data line driving circuit 2 is provided with a shift register circuit 11, a data register circuit 12, a data latching circuit 13, a data switching circuit 14, a level shift circuit 15, a positive DA converting circuit 16 for generating a positive signal, a negative DA converting circuit 17 for generating a negative signal, a buffer & switching circuit 18, a control circuit 20 for controlling various sections, a positive gradation voltage generating circuit 21 for generating a plurality of positive gradation voltages, and a negative gradation voltage generating circuit 22 for generating a plurality of negative gradation voltages. Here, the switching circuit 18 is composed of a plurality of switches and a plurality of buffers, to select the positive signal and the negative signal to supply to the data line. The detailed configuration thereof will be described below.

The shift register circuit 11 generates a sampling signal for the image signal in synchronization with a clock signal CLK. The data register circuit 12 holds the image signal in response to the sampling signal generated by the shift register circuit 11. The data latching circuit 13 latches the image signal held by the data register circuit 12 for a predetermined time period. The data switching circuit 14 selects the image signal supplied to predetermined pixels. The level shift circuit 15 converts a voltage level of image signal from a voltage level for the data switching circuit 14 to a voltage level of the DA converting circuits 16 and 17. Although the data switching circuit 14 and the level shift circuit 15 are provided for the data line driving circuit 2 in this embodiment, it is possible to omit the data switching circuit 14 from the data line driving circuit 2, by the display control circuit 10 carrying out the switching of the image data. Also, by employing a buffer having a gain (output voltage/input voltage) greater than 1, it is possible to omit the level shift circuit 15 from the data line driving circuit 2.

Figure 5:
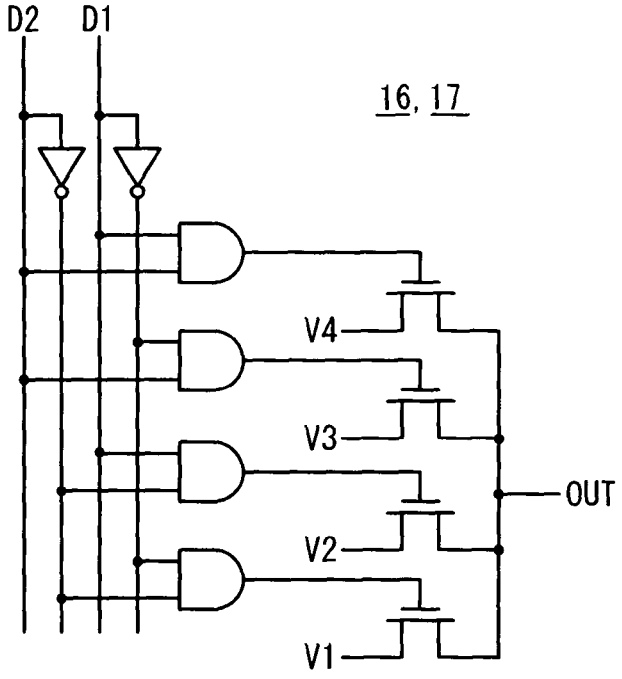
FIG. 5 is a circuit diagram showing a configuration of a DA converting circuit applied to the present invention.
Figure 6:
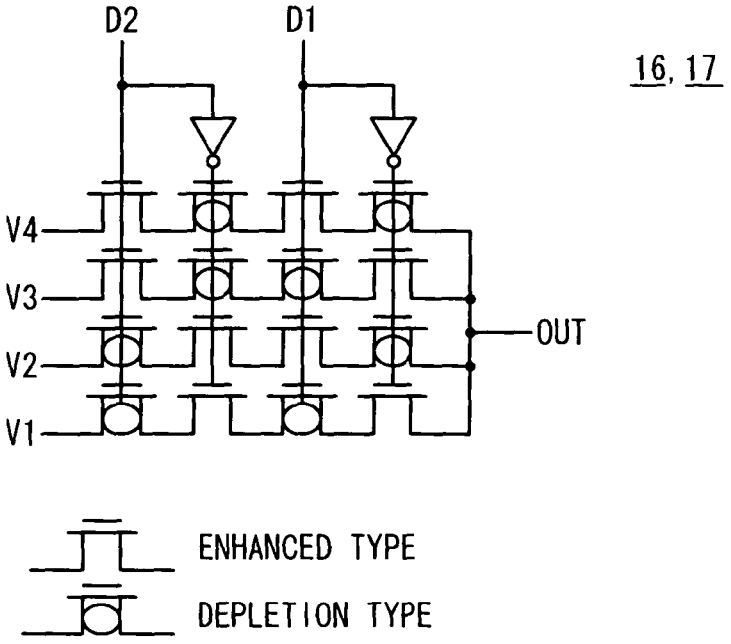
FIG. 6 is a circuit diagram showing another configuration of the DA converting circuit applied to the present invention.

The DA converting circuits 16 and 17 select ones of a plurality of gradation voltages generated by the gradation voltage generating circuits 21 and 22 in accordance with the image signal, respectively. In the following description, it is assumed that a portion of the image signal corresponding to each pixel has two bits for four gradations. FIG. 5 is a circuit diagram showing the configuration of the DA converting circuits 16 and 17 that use logic circuits. The converting circuit shown in FIG. 5 has four switches and the logic circuits connected to the switches. The four switches are used to select the gradation voltage to be sent to the switching circuit 18 from four gradation voltages V1, V2, V3 and V4 in response to signals outputted from the logic circuits in accordance with image data bits D1 and D2. FIG. 6 is a circuit diagram showing the configuration of the DA converting circuits 16 and 17 that use enhancement type transistors and depletion type transistors. The converting circuit shown in FIG. 6 has 16 switches and the logic circuits connected to the 16 switches. The 16 switches are used to select the gradation voltage to be sent to the switching circuit 18, from the four gradation voltages, because the ON/OFF states of the enhancement type transistors and the depletion type transistors are changed in accordance with the image data bits D1 and D2. The control circuit 20 controls the latch timing and carries out the control of the switching circuit 18 in accordance with control signals POL, STB, and SWCOT supplied from the display control circuit 10. Each of the gradation voltage generating circuits 21 and 22 generates the plurality of gradation voltages. The gradation voltage generating circuits 21 and 22 include resistor dividing circuits (not shown) in which a plurality of resistors are connected in series, and the resister dividing circuits generate the plurality of gradation voltages from reference voltages through the resistor division. In this example, the positive gradation voltage generating circuit 21 generates the positive gradation voltages, and the negative gradation voltage generating circuit 22 generates the negative gradation voltages.

Figure 7:
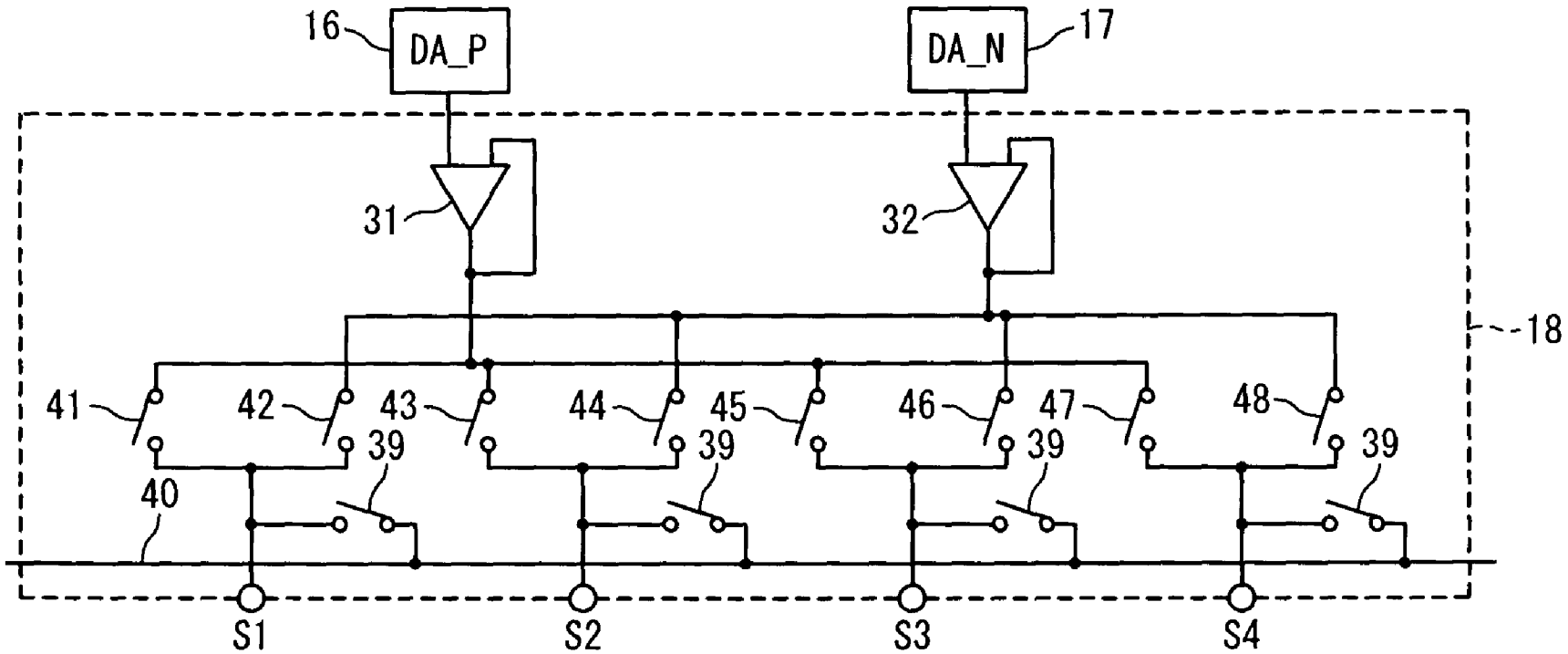
FIG. 7 is a circuit diagram showing configurations of the buffer & switching circuit in the first embodiment.

The buffer & switching circuit 18 provided in the data line driving circuit 2 will be described below in detail. FIG. 7 is a circuit diagram showing the configuration of the buffer & switching circuit 18. In the following description, it is assumed that the number of the data lines 7 is 4, for easy understanding the present invention. With reference to FIG. 7, the switching circuit 18 is provided with a first buffer 31, a second buffer 32, a plurality of switches 41 to 48, and a plurality of common line connection switches 39 connected to a common line 40. Also, the switching circuit 18 has a plurality of data line connection terminals S1 to S4, each of which is connected to the corresponding data line. As shown in FIG. 7, the switching circuit 18 is installed between the data line 7 and the positive DA converting circuit 16 or between the data line 7 and the negative DA converting circuit 17. An output of the positive DA converting circuit 16 is connected to an input of the first buffer 31, and an output of the negative DA converting circuit 17 is connected to an input of the second buffer 32. Positive side switches 41, 43, 45 and 47 are provided between an output of the first buffer 31 and the respective data line connection terminals S1 to S4, and negative side switches 42, 44, 46 and 48 are provided between an output of the second buffer 32 and the respective data line connection terminals S1 to S4. The buffers 31 and 32 are composed of voltage followers, current sources and the like to generate desirable analog image signals (gradation voltage or gradation current) from the gradation voltages selected by the DA converting circuits 16 and 17. The switches may be controlled in response to control signals from the control circuit 10 or another section.

The common line connection switch 39 is set to an ON state before the polarity of the signal to be supplied to the data line 7 is changed from the positive side to the negative side or from the negative side to the positive side, i.e., a next scan line is driven. Thus, the data line 7 and the common line 40 are short-circuited. In the dot inversion drive, the number of the data lines charged positively is equal to the number of the data lines charged negatively. Therefore, before the positive analog image signal or negative analog image signal is supplied to each data line 7, the data lines 7 and the common line 40 are connected so that the voltages of the data lines 7 are neutralized. Consequently, the consumed power can be reduced.

Figure 8:
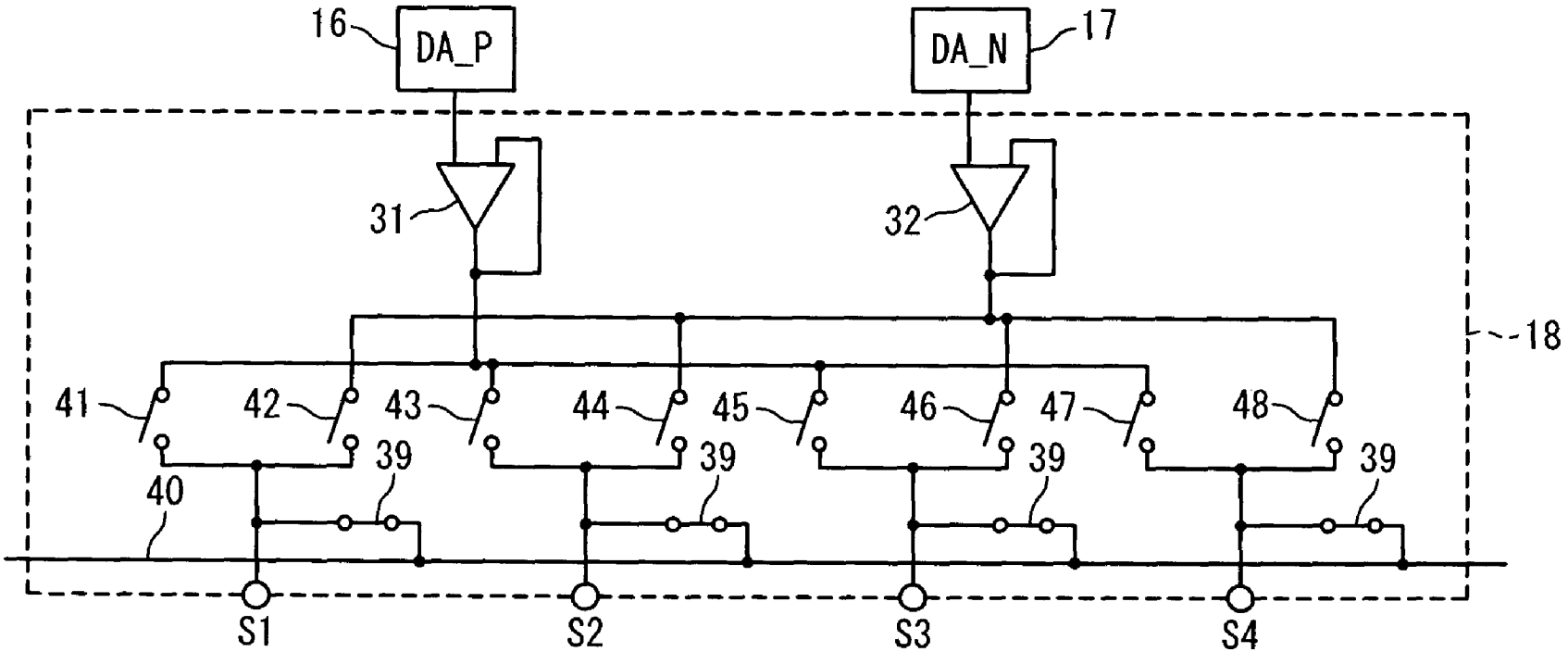
FIG. 8 is a circuit diagram showing a connection state when common line connection switches in the switching circuit are turned on at a same time in the first embodiment.

FIG. 8 is a circuit diagram showing a connection state when the common line connection switches 39 in the switching circuit 18 are turned on at the same time. As shown in FIG. 8, when the switches 39 are turned on, the other switches 41 to 48 are turned off. Since the common line connection switches 39 on both of the upper and low sides of the liquid crystal display panel 5 are turned on at the same time, the heat generation of the data line driving circuit 2 at the time of connection of the common line can be dispersed. It should be noted that the voltage of the common electrode may be supplied to the common line 40 or not. The common line voltage may be the grounded voltage or another voltage.

Figure 9:
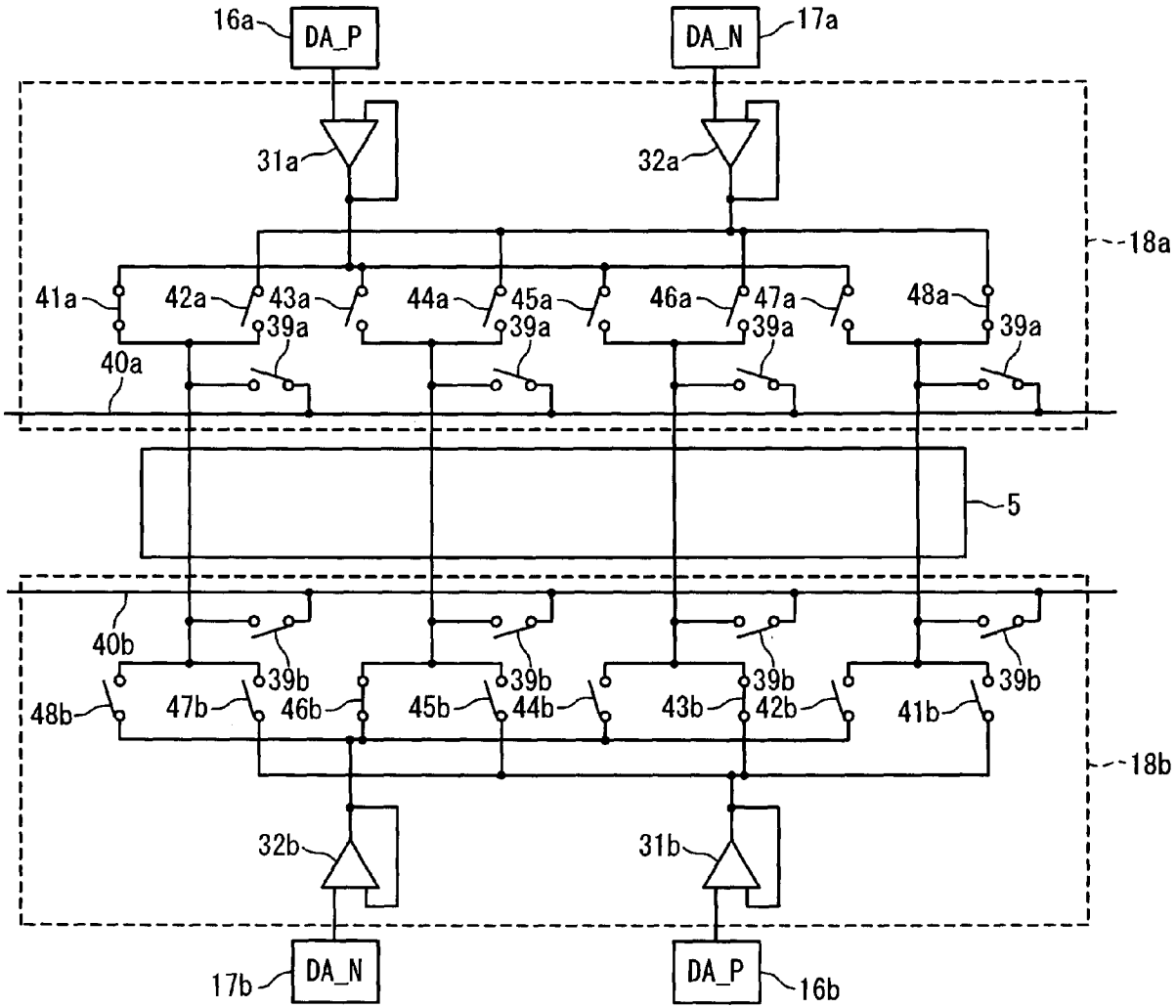
FIG. 9 is a circuit diagram showing the configuration of the switching circuit in the first embodiment.

FIG. 9 is a circuit diagram showing the circuit configuration of the switching circuit 18 when the data line driving circuits 2 are connected to the upper and low sides of the liquid crystal display panel 5 to oppose to each other, respectively. As mentioned above, in the following example, the data line driving circuit provided on the upper side of the liquid crystal display panel 5 is referred to as a first data line driving circuit 2*a*, and the data line driving circuit provided on the low side is referred to as a second data line driving circuit 2*b*. Also, when the first data line driving circuit 2*a* and the second data line driving circuit 2*b* are distinguished from each other, the symbol a is added after the number when the circuit is provided on the upper side, and the symbol b is added after the number when the circuit is provided on the low side.

Figures 10A, 10B, 10C, 10D, 10E, 10F:
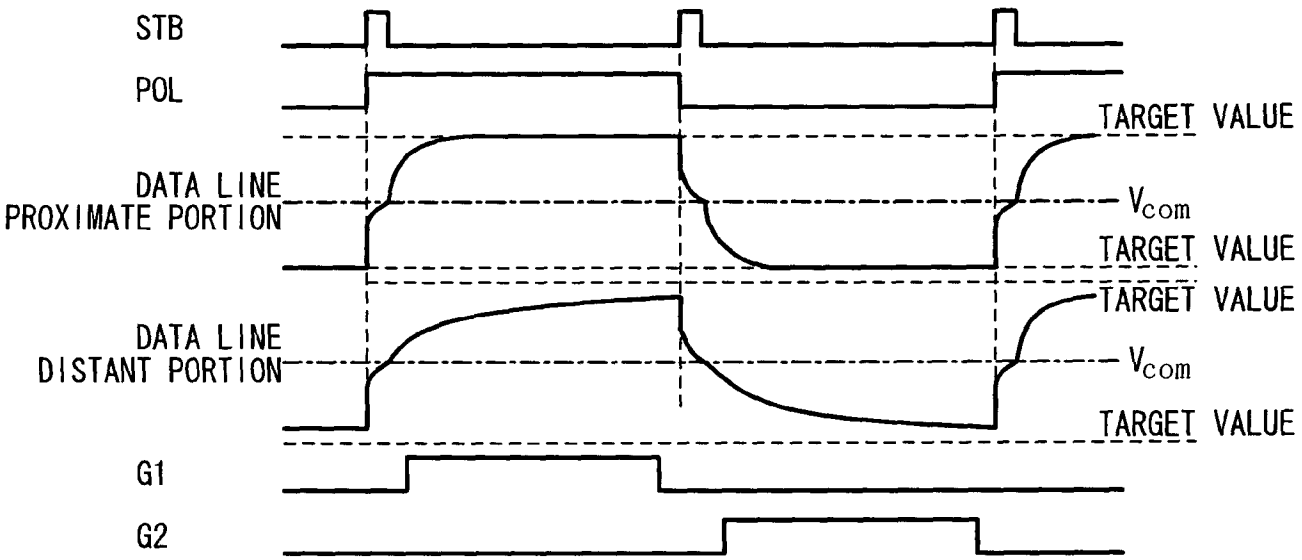
FIGS. 10A to 10F are waveforms showing voltage waveform of a data line in the first embodiment.
Figures 12A, 12B, 12C, 12D:
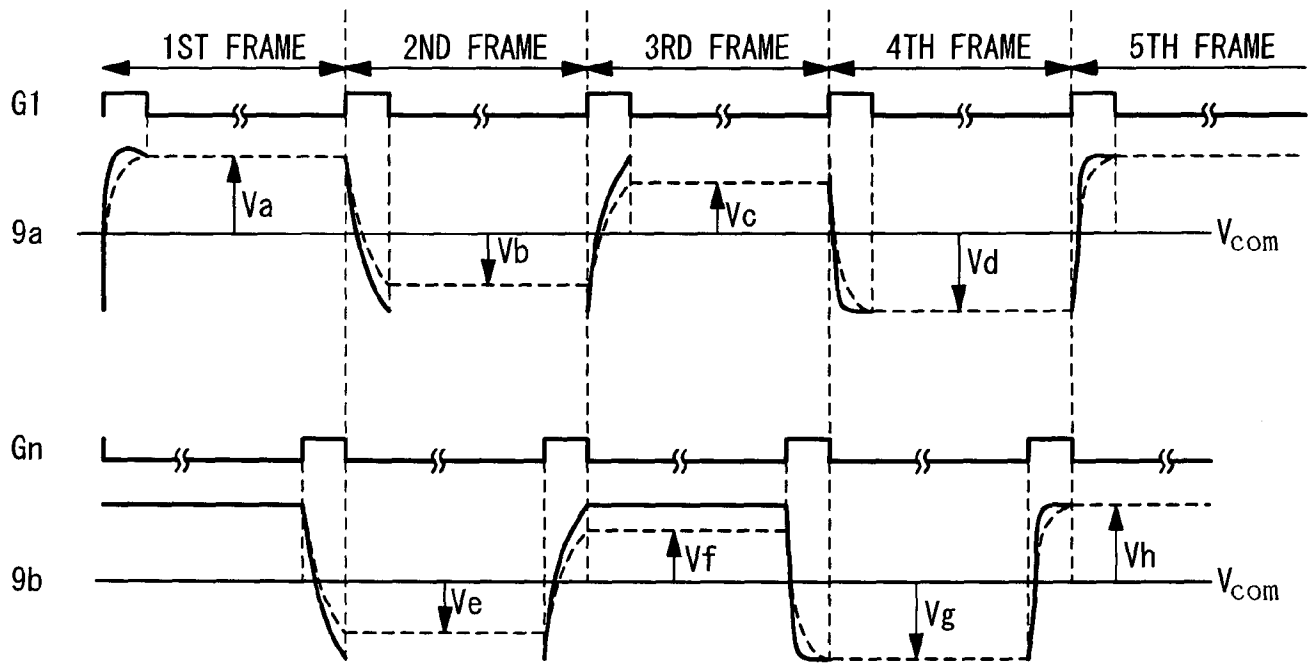
FIGS. 12A to 12D are waveforms showing an operation when the pixels are driven in the period of four frames in the first embodiment.

Here, a signal waveform outputted from the data line driving circuit 2 will be described. FIGS. 10A to 10F are waveforms on the data line driving circuit 2. FIG. 10C is a waveform of a signal voltage applied to the pixel near to the data line driving circuit 2, and FIG. 10D is a waveform of a signal voltage applied to the pixel distant from the data line driving circuit 2. With reference to FIGS. 10A to 10F, the voltage applied to the pixel near the data line driving circuit 2 reaches a target voltage, abut the voltage applied to the pixel distant from the data line driving circuit 2 does not reach the target voltage. The dullness in the waveform of the signal voltage applied to the distant pixel is caused due to a load capacitance and a load resistance of the data line 7 because the liquid crystal display panel 5 is designed so as to be larger in scale and higher in definition. The signal voltage applied to the pixel is approximately determined based on a time constant $\tau$=CR, where R is resistance and C is capacitance. In short, as the pixel is located farther from the data line driving circuit 2, the product of CR is greater, and the waveform is duller.

FIGS. 11A and 11B are tables showing the operations when the pixels 9*a* and 9*b* are driven in the present invention. The table in FIG. 11A shows the data line driving circuit for driving the pixel 9 and a signal supplied to the pixel 9 from the data line driving circuit. Here, the symbols "up", "down", "+" and "−" are shown in FIG. 11A. The symbol "up" indicates the first data line driving circuit 2*a*, and "down" indicates the second data line driving circuit 2*b*. Also, "+" indicates the positive analog image signal, and "−" indicates the negative analog image signal. With reference to FIG. 11A, the pixel 9 is driven based on the positive analog image signal from the first data line driving circuit 2*a* in the first frame, driven based on the negative analog image signal from the second data line driving circuit 2*b* in the second frame, driven based on the positive analog image signal from the second data line driving circuit 2*b* in the third frame, and then driven based on the negative analog image signal from the first data line driving circuit 2*a* in the fourth frame. The operation in those four frames is cyclically executed.

Also, FIG. 11B is a table showing another operation when the pixels 9 re driven in the present invention. The symbols of "up", "down", "+" and "−" are shown in FIG. 11B and have the meanings similar to those of FIG. 11A. With reference to FIG. 11B, the pixel 9 is driven based on the positive analog image signal from the first data line driving circuit 2*a* in the first frame, driven based on the negative analog image signal from the first data line driving circuit 2*a* in the second frame, driven based on the positive analog image signal from the second data line driving circuit 2*b* in the third frame, and then driven based on the negative analog image signal from the second data line driving circuit 2*b* in the fourth frame. The operation in those fourth frames is cyclically executed.

The operation waveforms when the above operations are carried out will be described below. It should be noted that in the following description, a pixel 9A is assumed to be near the first data line driving circuit 2*a* arranged on the upper side of the liquid crystal display panel 5, and a pixel 9*b* is assumed to be near the second data line driving circuit 2*b* arranged on the low side of the liquid crystal display panel 5. Also, the scan line driving circuit 3 is assumed to sequentially scan the scan lines 8 from the upper side to the low side.

FIGS. 12A to 12D show the operation waveforms when the pixels 9 are driven in the period of four frames shown in FIG. 11A. As shown in FIGS. 12A to 12D, the pixel 9*a* receives the positive analog image signal from the first data line driving circuit 2*a* in the first frame and holds a positive voltage Va approximately close to the target value, since the TFT is turned OFF; and receives the negative analog image signal from the second data line driving circuit 2*b* in the second frame and holds a negative voltage Vb that does not reach a target value. Also, the pixel 9*a* receives the positive analog image signal from the second data line driving circuit 2*b* in the third frame and holds a positive voltage Vc that does not reach the target value, and then receives the negative analog image signal from the first data line driving circuit 2*a* in the fourth frame and holds a negative voltage Vd approximately close to the target value. The pixel 9*b* receives the negative analog image signal from the first data line driving circuit 2*a* in the first frame and holds a negative voltage Ve that does not reach the target value, and receives the positive analog image signal from the first data line driving circuit 2*a* in the second frame and holds a positive voltage Vf that does not reach the target value. Also, the pixel 9*b* receives the negative analog image signal from the second data line driving circuit 2*b* in the third frame and holds a negative voltage Vg approximately close to the target value, and then receives the positive analog image signal from the second data line driving circuit 2*b* in the fourth frame and holds a positive voltage Vh approximately close to the target value. The relation between the voltages Va, Vb, Vc and Vd supplied to the pixel 9*a* and the voltages Ve, Vf, Vg and Vh supplied to the pixel 9*b* is Va+Vb+Vc+Vd≈Ve+Vf+Vg+Vh. That is, from the combination of [Positive signal and Negative signal] and [Great and Small of Waveform Dullness], the charges accumulated in the pixels are averaged to eliminate the brightness deviation depending on the pixel position by setting the four frames as one cycle. Consequently, a summation of the voltages applied to the pixel 9*a* from the first frame to the fourth frame and a summation of the voltages applied to the pixel 9*b* from the first frame to the fourth frame become substantially equal. Thus, the difference in the brightness (transmission factor) is never generated between the pixel 9*a* and the pixel 9*b*.

Next, the control of the switching circuit 18 in the (1H1V) drive for inverting the polarity of the signal for each scan line, so that the polarity of the signal is different for every data line, will be described below. It should be noted that in the following description, pixels of 4×4 will be exemplified for easy understanding. Also, symbols "1" to "4" written on the left side of the table are the first to fourth scanning operations in FIGS. 13A to 13D.

With reference to FIGS. 13A to 13D, in the first scanning operation of the first frame, the first data line driving circuit 2*a* turns on a positive side switch 41*a* and a negative side switch 48*a* in the first switching circuit 18*a*. Also, the second data line driving circuit 2*b* turns on a positive side switch 43*b* and a negative side 46*b* in the second switching circuit 18*b*. At this time, the first data line driving circuit 2*a* turns off the other switches 42*a* to 47*a*, and the second data line driving circuit 2*b* turns off the other switches 41*b*, 42*b*, 44*b*, 45*b*, 47*b* and 48*b*. Through this switching control, the first data line driving circuit 2*a* and the second data line driving circuit 2*b* drive the respective data lines to (up +, down −, down +, and up −).

As mentioned above, "up +" indicates that the first data line driving circuit 2*a* drives the data line 7 to the positive voltage, "up −" indicates that the first data line driving circuit 2*a* drives the data line 7 to the negative voltage, "down +" indicates that the second data line driving circuit 2*b* drives the data line 7 to the positive voltage, and "down −" indicates that the second data line driving circuit 2*b* drives the data line 7 to the negative voltage.

The second to fourth scanning operations will be described below. It should be noted that in the following description, description of the switches in the off state is omitted. In the second scanning operation in the first frame, the switches 46*a* and 47*a* and the switches 45*b* and 48*b* are turned on, and the data lines are driven to (down −, down +, up −, and up +). In the third scanning operation in the first frame, the switches 44*a* and 45*a* and the switches 42*b* and 47*b* are turned on, and the data lines are driven to (down +, up −, up +, down −). At the fourth scanning operation of the one frame, the switches 42*a* and 43*a* and the switches 41*b* and 44*b* are turned on, and the data lines are driven to (up −, up +, down −, down +). Also, after the second frame, the switches 41*a* to 48*a*, and 41*b* to 48*b* are controlled, and the data lines are driven as shown in FIGS. 13A to 13D. In the 1H1V drive, a drive cycle of four frames is cycled. Thus, the voltages applied to the pixels can be averaged, thereby improving the brightness difference between the upper and low portions of the panel.

Also, the control of the switching circuit 18 will be described in case of the (1H2V) drive for inverting the polarity of the signal for every scan line, in which the polarity of the signal is different for every two data lines. FIGS. 14A to 14D are diagrams showing states of a table for the control operation of the switching circuit 18 in the case of the 1H2V drive. As shown in FIGS. 14A to 14D, even in case of the 1H2V drive, the cycle of four frames is circulated. Thus, the voltages to be supplied to the pixels can be averaged, thereby improving the brightness difference between the upper and low portions of the panel.

Second Embodiment

The liquid crystal display apparatus according to the second embodiment of the present invention will be described below. In the first embodiment as mentioned above, the data line driving signal is inverted for each scan line, and the four frames are used as one cycle. In the second embodiment as described below, the data line driving signal is inverted for every two scan lines (2H inversion drive), and eight frames are used as one cycle.

FIGS. 15A to 15H show an example in which the respective pixels in the (2H1V) drive for inverting the polarity of the signal for every two scan lines, in which the polarity of the signal is different for every data line. In the 2H inversion drive, the one scan line and the two scan lines are driven in the same polarity. For this reason, although the drive waveform of the first scan line is made dull, the drive waveform of the second scan line is not made dull. Thus, a lateral stripe is generated because the pixel voltages of the pixels of the first scan line and the pixel voltages of the pixels of the second scan line are different. In the second embodiment, in the first to fourth frames, the scan lines are sequentially driven from the upper portion to the low portion in an order of G1-G2-G3-G4, and in the fifth to eighth frames, the scan lines are driven by switching the order for each two scan lines in an order of G2- G1-G4-G3 - - - . Consequently, the drive waveforms of the data lines in the first scan line and the second scan line can be averaged, thereby improving the image quality.

Also, FIGS. 16A to 16H show an example in which the respective pixels in the (2H2V) drive for inverting the polarity of the signal for every two scan lines, in which the polarity of the signal is different for every two data lines. In this way, in the nH inversion drive, when the 4×n frames is set as one cycle, the data lines are cycled, the pixel voltages can be averaged, thereby removing the brightness difference and improving the image quality.

Third Embodiment

In the first embodiment as mentioned above, the first buffer 31 and the second buffer 32 which are installed in the switching circuit 18 are connected to the outputs of the DA converting circuits 16 and 17. Switches may be provided between the DA converting circuits 16 and 17, the first buffer 31 and the second buffer 32.

Figure 17:
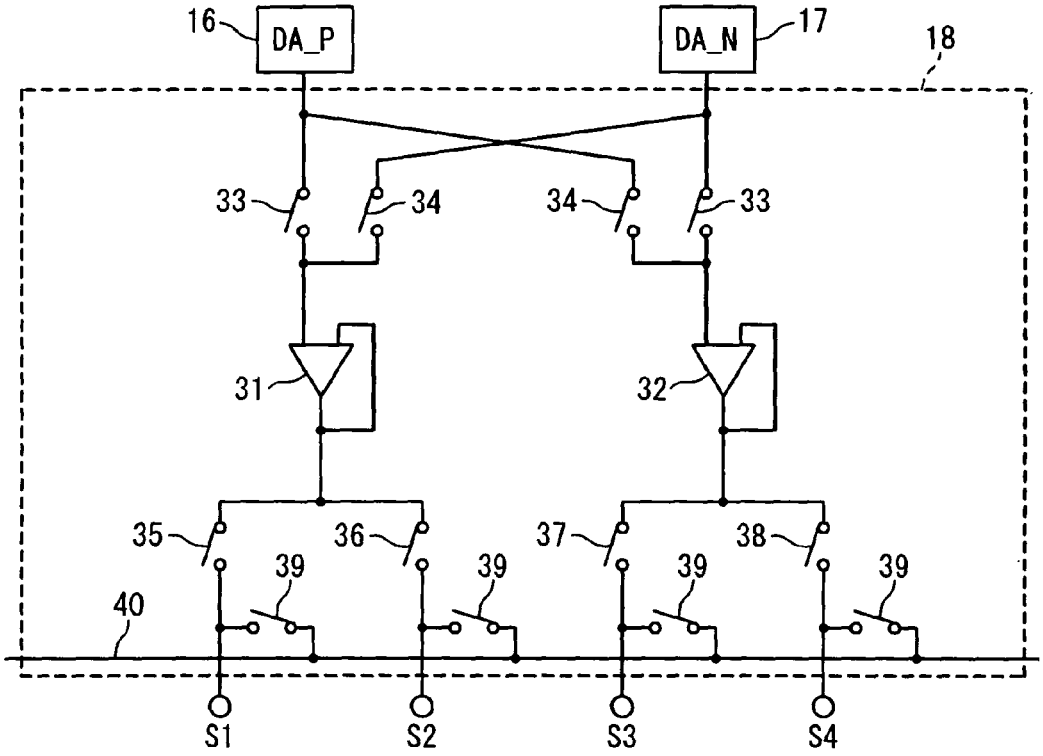
FIG. 17 is a circuit diagram showing configurations of the switching circuit in a third embodiment.

FIG. 17 is a circuit diagram showing the configuration of a switching circuit 18 in the third embodiment. With reference to FIG. 17, the switching circuit 18 in the third embodiment is provided with switching switches 33, switching switches 34 and a plurality of connection switches 35 to 38. As shown in FIG. 17, the switching switches 33 are provided between the positive DA converting circuit 16 and the buffer 31 and between the negative DA converting circuit 17 and the buffer 32. Also, the switching switches 34 are provided between the positive DA converting circuit 16 and the buffer 32 and between the negative DA converting circuit 17 and the buffer 31. Moreover, the connection switch 35 is provided between the first buffer 31 and a first data line connection terminal S1, and the connection switch 36 is provided between the first buffer 31 and a second data line connection terminal S2. Also, the connection switch 37 is provided between the second buffer 32 and a third data line connection terminal S3, and the connection switch 38 is provided between the second buffer 32 and a fourth data line connection terminal S4. Moreover, the common line connection switches 39 are provided between the respective data line connection terminals S1, S2, S3 and S4 and the common line 40. The switching circuit 18 is controlled by using the 4×n frames as one cycle.

Figure 18:
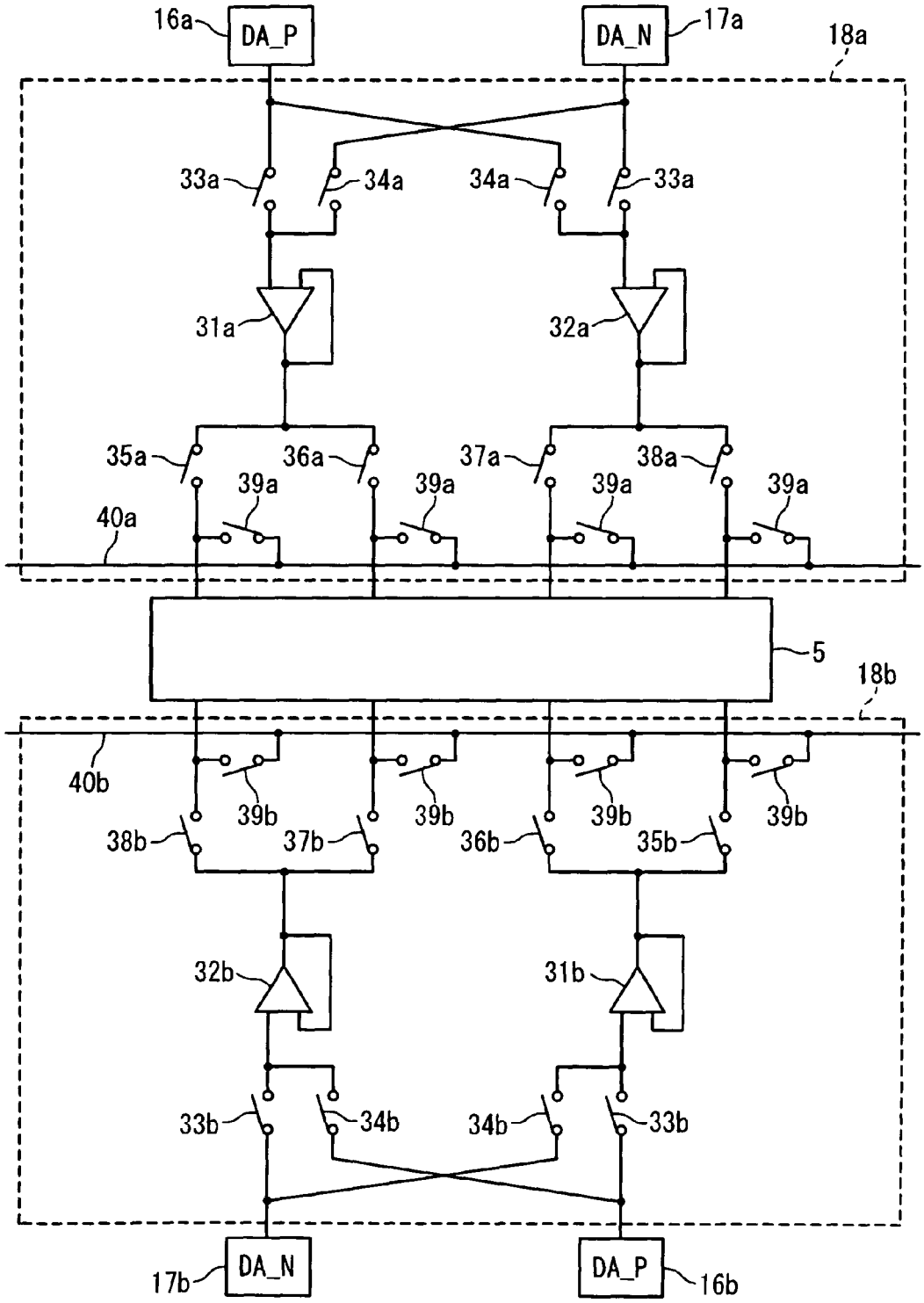
FIG. 18 is a circuit diagram showing the configuration of the switching circuits in the third embodiment.

FIG. 18 is a circuit diagram showing the configuration of the first switching circuit 18*a* and the second switching circuit 18*b* in the third embodiment. As shown in FIG. 18, the first data line driving circuit 2*a* having the first switching circuit 18*a* and the second data line driving circuit 2*b* having the second switching circuit 18*b* are installed on the upper side and lower side of the liquid crystal display panel 5 to oppose to each other. FIG. 18 shows the connection state when in the first switching circuit 18*a*, a switching switch 33*a* is turned on, a connection switch 35*a* and a connection switch 38*a* are turned on, a switching switch 33*b* is turned on, and a connection switch 37*b* and a connection switch 36*b* are turned on.

In the above embodiments, since the voltage precision in the DA converting circuits and the buffer circuits is higher on a semiconductor substrate than on a glass substrate, it is preferable that the first data line driving circuit 2*a* and the second data line driving circuit 2*b* are manufactured on different substrates. Also, the above embodiments may be combined when any contradiction is not caused in their configurations and operations.

According to the present invention, the contrasts of the display panel installed in the large liquid crystal display apparatus can be made uniform, thereby improving the image quality. Also, the heat generation of the data line driving circuit can be dispersed, thereby improving the quality of the driving circuit.

What is claimed is:

1. A data line driving circuit which supplies an analog image signal to 4×M data lines, where M is a natural number, the circuit comprising:

M positive driving circuits configured to output a positive analog image signal which is positive with respect to a reference voltage;

M negative driving circuits configured to output a negative analog image signal which is negative with respect to said reference voltage;

4×M analog image signal output terminals; and a switching circuit connected with said 4×M data lines through said 4×M analog image signal output terminals, wherein said switching circuit switches between a first state in which said positive analog image signal is supplied to said data lines, a second state in which said negative analog image signal is supplied to said data lines, and a third state as a high impedance state in which no signal is supplied to said data lines, wherein said switching circuit comprises:

a first buffer circuit connected with said positive driving circuits;

a second buffer circuit connected with said negative driving circuits;

a first switch group provided between said first buffer circuit and said analog image signal output terminals to control a connection between said first buffer circuit and said analog image signal output terminals, said first switch group configured to selectively control a connection between said first buffer circuit and said positive driving circuits; and a second switch group provided between said second buffer circuit and said analog image signal output terminals to control a connection between said second buffer circuit and said analog image signal output terminals, said second switch group configured to selectively control connection between said second buffer circuit and said negative driving circuits, and said switching circuit supplies said positive analog image signal and said negative analog image signal to said 4×M data lines by closing said first switch group and said second switch group in a predetermined order.

2. The data line driving circuit according to claim 1, wherein said switching circuit further comprises:

a third switch group configured to control a connection of said analog image signal output terminals and a common line of said data line driving circuit before a polarity of said voltage signal supplied to said data line is changed.

* * * * *